US007628731B2

(12) United States Patent
McGee et al.

(10) Patent No.: US 7,628,731 B2
(45) Date of Patent: Dec. 8, 2009

(54) SPRING ARRANGEMENT FOR A RECREATIONAL STRUCTURE

(75) Inventors: Craig E. McGee, Allen, TX (US); Jeffry L. VanElverdinghe, Beaverton, OR (US); Craig Adams, Portland, OR (US)

(73) Assignee: CA06, LLC, Portland, OR (US)

( * ) Notice: Subject to any disclaimer, the term of this patent is extended or adjusted under 35 U.S.C. 154(b) by 156 days.

(21) Appl. No.: 11/379,770

(22) Filed: Apr. 21, 2006

(65) Prior Publication Data

US 2006/0258510 A1 Nov. 16, 2006

Related U.S. Application Data

(63) Continuation-in-part of application No. 10/908,470, filed on May 12, 2005, now Pat. No. 7,396,318.

(51) Int. Cl.
*A63B 5/11* (2006.01)

(52) U.S. Cl. ..... 482/27

(58) Field of Classification Search ..... 482/26–29, 482/74, 77; 473/421; 5/233; 182/139; D21/797
See application file for complete search history.

(56) References Cited

U.S. PATENT DOCUMENTS

| | | | | |
|---|---|---|---|---|
| 2,370,990 | A * | 3/1945 | Nissen | 482/28 |
| 2,858,551 | A * | 11/1958 | Sidlinger | 5/110 |
| 2,991,841 | A * | 7/1961 | Sampson et al. | 482/27 |
| 3,031,688 | A | 5/1962 | Southwood | |
| 3,077,149 | A * | 2/1963 | Eckel | 267/89 |
| 3,233,895 | A * | 2/1966 | Grelle et al. | 482/27 |
| 3,502,330 | A * | 3/1970 | Cheftel | 273/395 |
| 3,938,792 | A | 2/1976 | Nissen | |
| 3,948,515 | A | 4/1976 | McNeil | |
| 3,983,585 | A | 10/1976 | Sidlinger | |
| 4,045,021 | A | 8/1977 | Nissen | |
| 4,139,192 | A | 2/1979 | McNeil | |
| RE30,344 | E | 7/1980 | McNeil | |
| 4,284,271 | A | 8/1981 | Pettit et al. | |
| 4,339,123 | A | 7/1982 | Rich | |
| 4,386,772 | A | 6/1983 | Wu | |

(Continued)

FOREIGN PATENT DOCUMENTS

| | | |
|---|---|---|
| DE | 295 01 890 U1 | 3/1995 |

(Continued)

*Primary Examiner*—Loan H Thanh
*Assistant Examiner*—Sandhara M Ganesan
(74) *Attorney, Agent, or Firm*—Harness, Dickey & Pierce, P.L.C.

(57) ABSTRACT

A spring arrangement for a trampoline includes a rebounding surface, a frame structure having a top portion and a bottom portion, and a plurality of spring members that are mechanically coupled between the rebounding surface and the frame structure. A first group of spring members are mechanically coupled to the top portion of the frame structure and a second group of spring members are mechanically coupled to the bottom portion of the frame structure. In one illustrative embodiment, each spring member of the second group of spring members has a frame hook member that is mechanically coupled to the bottom portion of the frame structure and a bed hook member that includes an end portion that is configured to be within a projection of a body of the spring member and is coupled to the rebounding surface.

25 Claims, 5 Drawing Sheets

U.S. PATENT DOCUMENTS

| | | | | |
|---|---|---|---|---|
| 4,433,838 | A | 2/1984 | Gordon | |
| 4,489,933 | A | 12/1984 | Fisher et al. | |
| 4,548,405 | A | 10/1985 | Lee et al. | |
| 4,569,515 | A | 2/1986 | Gordon | |
| 4,576,375 | A | 3/1986 | Roberts | |
| 4,598,904 | A | 7/1986 | Roth | |
| 4,644,892 | A | 2/1987 | Fisher | |
| 4,730,826 | A | 3/1988 | Sudmeier | |
| 4,776,581 | A | 10/1988 | Shepherdson | |
| 4,836,530 | A | 6/1989 | Stanley, Jr. | |
| 4,863,156 | A | 9/1989 | Shaw | |
| 4,900,011 | A | 2/1990 | Nolet | |
| 4,938,473 | A | 7/1990 | Lee et al. | |
| 4,976,022 | A | 12/1990 | Thornton et al. | |
| 5,299,989 | A | 4/1994 | Boyd et al. | |
| 5,330,401 | A | 7/1994 | Walstead | |
| 5,336,135 | A | 8/1994 | Keyvani | |
| 5,371,936 | A | 12/1994 | Blanchard | |
| 5,385,518 | A | 1/1995 | Turner | |
| 5,477,599 | A | 12/1995 | Blanchard | |
| 5,545,110 | A * | 8/1996 | Hsiang | 482/27 |
| 5,674,157 | A | 10/1997 | Wilkinson | |
| 5,810,695 | A | 9/1998 | Sass | |
| 5,833,557 | A | 11/1998 | Cole | |
| 5,941,798 | A | 8/1999 | Coan et al. | |
| 6,001,045 | A * | 12/1999 | Gift et al. | 482/27 |
| 6,017,292 | A | 1/2000 | Gift et al. | |
| 6,036,620 | A * | 3/2000 | Yang | 482/27 |
| 6,053,845 | A | 4/2000 | Publicover et al. | |
| 6,110,074 | A | 8/2000 | Tacquet | |
| 6,139,474 | A | 10/2000 | Gift et al. | |
| 6,162,061 | A | 12/2000 | Taylor | |
| 6,193,632 | B1 | 2/2001 | Steger | |
| 6,237,169 | B1 * | 5/2001 | Ying | 5/111 |
| 6,261,207 | B1 | 7/2001 | Publicover et al. | |
| 6,283,894 | B1 | 9/2001 | Steger | |
| 6,319,174 | B1 | 11/2001 | Alexander | |
| 6,402,662 | B1 | 6/2002 | Rieber | |
| 6,508,682 | B1 | 1/2003 | Clark | |
| 6,560,795 | B2 | 5/2003 | Hsia | |
| 6,607,468 | B1 | 8/2003 | Nichols, Jr. et al. | |
| 6,648,799 | B2 | 11/2003 | Hall | |
| 6,676,546 | B2 | 1/2004 | Gordon | |
| 6,679,811 | B2 | 1/2004 | Chen | |
| 6,682,444 | B2 | 1/2004 | Gordon | |
| 6,733,420 | B1 | 5/2004 | Schroeder | |
| 6,742,202 | B2 | 6/2004 | Jones | |
| 6,840,891 | B2 * | 1/2005 | Publicover | 482/27 |
| 6,846,271 | B2 * | 1/2005 | Publicover | 482/27 |
| 7,060,001 | B2 * | 6/2006 | Publicover | 482/27 |
| 2001/0000250 | A1 | 4/2001 | Steger | |
| 2002/0098948 | A1 | 7/2002 | Yoon | |
| 2002/0137598 | A1 | 9/2002 | Publicover et al. | |
| 2002/0160884 | A1 | 10/2002 | Hall | |
| 2003/0036460 | A1 | 2/2003 | Publicover | |
| 2003/0104905 | A1 * | 6/2003 | Publicover | 482/27 |
| 2004/0107491 | A1 | 6/2004 | Publicover | |
| 2004/0121883 | A1 | 6/2004 | Publicover | |
| 2004/0171461 | A1 | 9/2004 | Alexander | |
| 2004/0171462 | A1 | 9/2004 | Alexander | |
| 2004/0176214 | A1 | 9/2004 | Yueh | |
| 2005/0032609 | A1 | 2/2005 | Nissen et al. | |
| 2005/0037896 | A1 * | 2/2005 | Publicover | 482/27 |
| 2005/0054485 | A1 | 3/2005 | McDermott et al. | |

FOREIGN PATENT DOCUMENTS

| | | |
|---|---|---|
| EP | 1 721 640 A1 | 8/2006 |
| WO | WO 02/13913 | 2/2002 |

* cited by examiner

SPRING ARRANGEMENT FOR A RECREATIONAL STRUCTURE

CROSS-REFERENCE TO RELATED APPLICATION

The present patent application is a continuation-in-part patent application of U.S. patent application Ser. No. 10/908,470, filed May 12, 2005, and invented by Jeffry VanElverdinghe and Craig Adams, and which is incorporated by reference herein.

BACKGROUND

The subject matter disclosed herein relates to recreational structures. More particularly, the subject matter disclosed herein relates to a spring arrangement and a spring configuration for a recreational structure, such as a trampoline.

FIG. 1 illustratively depicts the forces that are applied to a frame of a trampoline that has conventionally configured spring members. More specifically, FIG. 1 illustratively depicts a cross-sectional view of a frame 101 is part of, for example, a circular frame that forms the perimeter of a trampoline. Frame 101 is disposed on a vertical frame member 102, such as a leg of the trampoline. A spring member 103 mechanically connects a rebounding surface (not shown) to frame 101. In particular, a hook member 104 that is part of spring member 103 is inserted through a hole 105 (not plainly shown in FIG. 1) that is in the "top" of frame 101. Other spring members that are disposed behind spring member 103 and are not visible in FIG. 1 are mechanically connected to frame 101 in the same manner has shown in FIG. 1.

As the rebounding surface of the trampoline is jumped on, a horizontal force 106 and a vertical force 107 are applied to spring member 103 that is transmitted to frame 101. The nature of the mechanical connection of spring member 103 to frame 101, that is, the mechanical connection of hook member 104 through hole 105, causes a torque 108 to be applied to frame 101. Torque 108 causes vertical frame member 102 to bow outward from the center of the trampoline, as depicted by arrow 109.

The cyclic loading caused by torque 108 has a tendency to cause fatigue in vertical frame member 102 at the mechanical connection between frame 101 and vertical frame member 102 and along the length of vertical frame member 102.

What is needed is a technique for reducing the torque applied to a frame member of a trampoline, thereby minimizing the bowing and the fatigue caused in a vertical frame member of a trampoline.

BRIEF SUMMARY

The subject matter disclosed herein provides a technique for reducing the torque applied to a frame member of a trampoline, thereby minimizing the bowing and the fatigue caused in a vertical frame member of a trampoline.

The subject matter disclosed herein provides a spring arrangement for a trampoline that includes a rebounding surface, a frame structure having a top portion and a bottom portion, and a plurality of spring members that when in use are mechanically coupled between the rebounding surface and the frame structure. According to the subject matter disclosed herein, a first group of spring members are mechanically coupled to the top portion of the frame structure and a second group of spring members are mechanically coupled to the bottom portion of the frame structure. In one illustrative embodiment, each spring member of the second group of spring members has a frame hook member that is mechanically coupled to the bottom portion of the frame structure and a bed hook member that includes an end portion that is configured to be within a projection of a body of the spring member and is coupled to the rebounding surface. In another illustrative embodiment, each spring member of the first and second groups of spring members has a frame hook member that is mechanically coupled to the top portion of the frame structure and a bed hook member that includes an end portion that is configured to be within a projection of a body of the spring member and is coupled to the rebounding surface. In still another illustrative embodiment, the spring members of the first group and the second group are alternately arranged along the frame structure. In yet another illustrative embodiment, the frame structure is formed by a plurality of frame members.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

The subject matter disclosed herein provides a technique for reducing the torque applied to a frame member of a trampoline, thereby minimizing the bowing and the fatigue caused in a vertical frame member of a trampoline.

Figure 1:
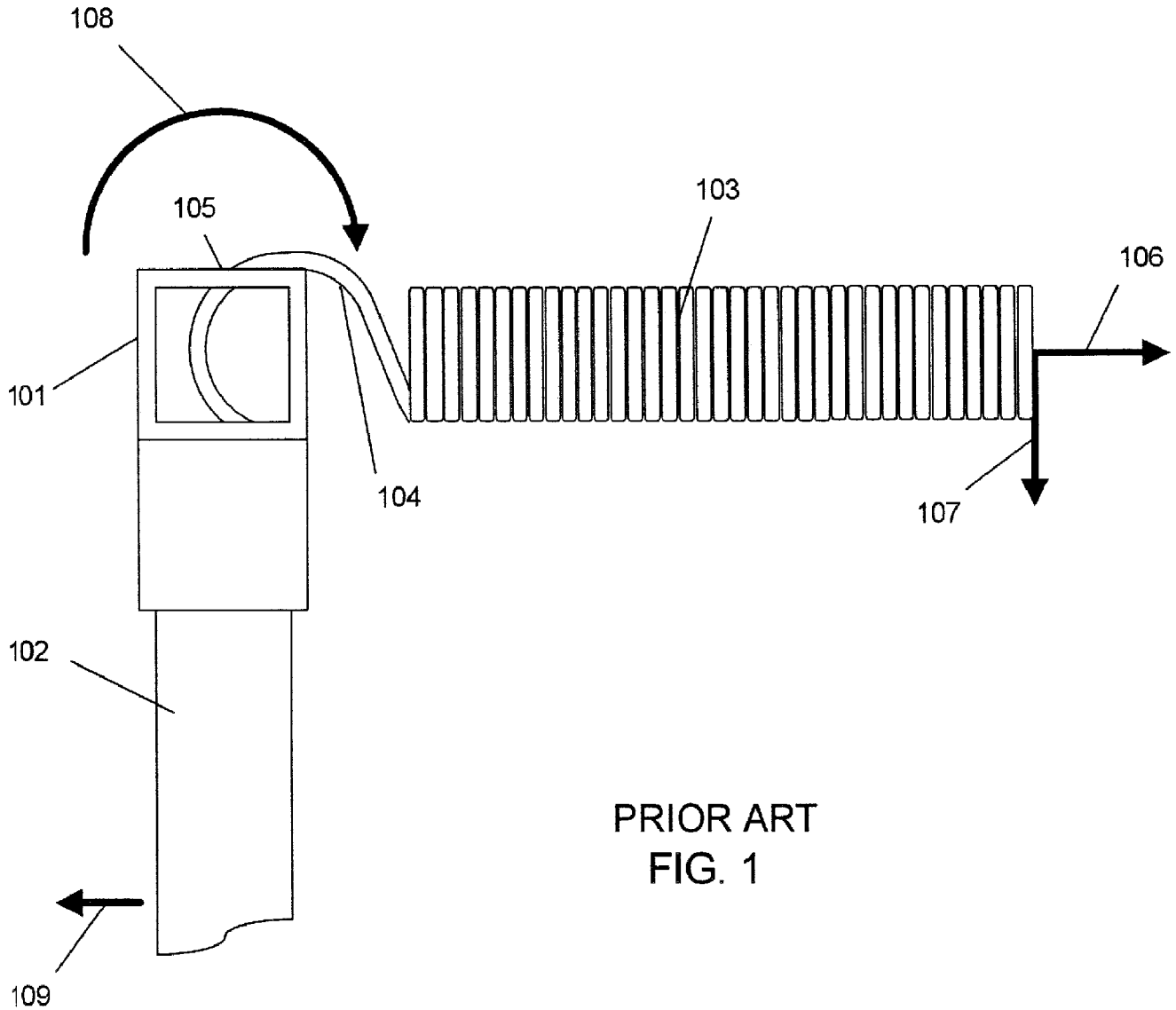
PRIOR ART FIG. 1
FIG. 1 illustratively depicts the forces that are applied to a frame of a trampoline that has conventionally configured spring members.
Figure 2:
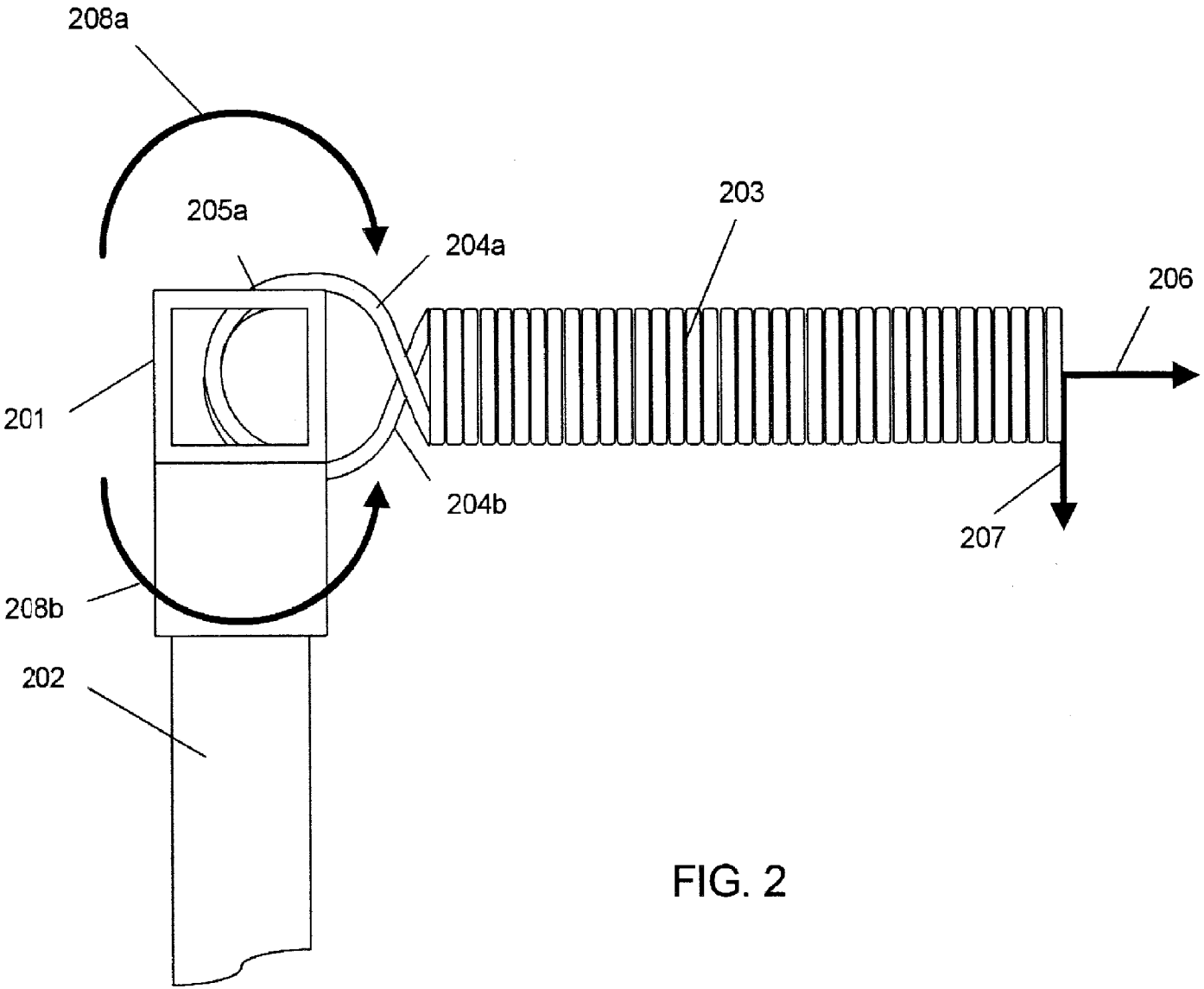
FIG. 2 illustratively depicts the forces that are applied to a frame of a trampoline that has spring members that are configured according to the subject matter disclosed herein.

FIG. 2 illustratively depicts the forces that are applied to an illustrative frame of a trampoline that has spring members that are configured according to the subject matter disclosed herein. More specifically, FIG. 2 illustratively depicts a cross-sectional view of a frame 201 is part of, for example, a circular frame that forms the perimeter of a trampoline. Frame 201 is disposed on a vertical frame member 202, such as a leg of the trampoline. A spring member 203 that is visible in FIG. 2 mechanically connects a rebounding surface 210 (not shown in FIG. 2) to frame 201. In particular, a frame hook member 204*a* that is part of spring member 203 is inserted through a hole 205*a* (not plainly shown in FIG. 2) that is in the "top" of frame 201. A second spring member that is disposed behind spring member 203 and that is not completely visible in FIG. 2 is mechanically connected to frame 201 by having a frame hook member 204*b* that is inserted through a hole (not visible in FIG. 2) that is in the "bottom" of frame 201. Each spring member 203 includes a bed hook member that hooks into, or engages, a connecting ring that is couple to or is part of the rebounding surface. In one illustrative embodiment of the subject matter disclosed herein, all of the spring members that mechanically connect the rebounding surface to frame 201 are alternately connected to the "top" and "bottom" of frame 201. In another illustrative embodiment of the subject matter disclosed herein, the spring members that mechanically connect the rebounding surface to frame 201 are connected to the "top" and "bottom" or frame 201 is a regular pattern. FIG. 3 is an illustrative top view of a portion of a trampoline having spring members 203 that mechanically connect a rebounding surface 210 to a trampoline frame 201 and are configured according to the subject matter disclosed herein. For example, spring members 203 include a bed hook member 402 that engages a ring member 211 of rebounding surface 210 and a frame hook member 204 that engages a frame hole 205.

As the rebounding surface of the trampoline is jumped on, a horizontal force 206 and a vertical force 207 are applied to spring member 203 that is transmitted to frame 201, as shown in FIG. 2. The alternating nature of each mechanical connection of spring members 203 to frame 201, that is, the mechanical connection of the corresponding hook member 204 through the top and bottom holes 205, cause a torque 208*a* and a torque 208*b* to be applied to frame 201. In particular, spring members that are mechanically connected to the "top" of frame 201 cause a torque 208*a* to be applied to frame 201. Spring members that are mechanically connected to the bottom of frame cause a torque 208*b* to be applied to frame 201. Torques 208*a* and 208*b* operate to cancel each other, and thereby reduces the tendency for vertical frame member 202 to bow outward from the center of the trampoline.

Figure 3A:
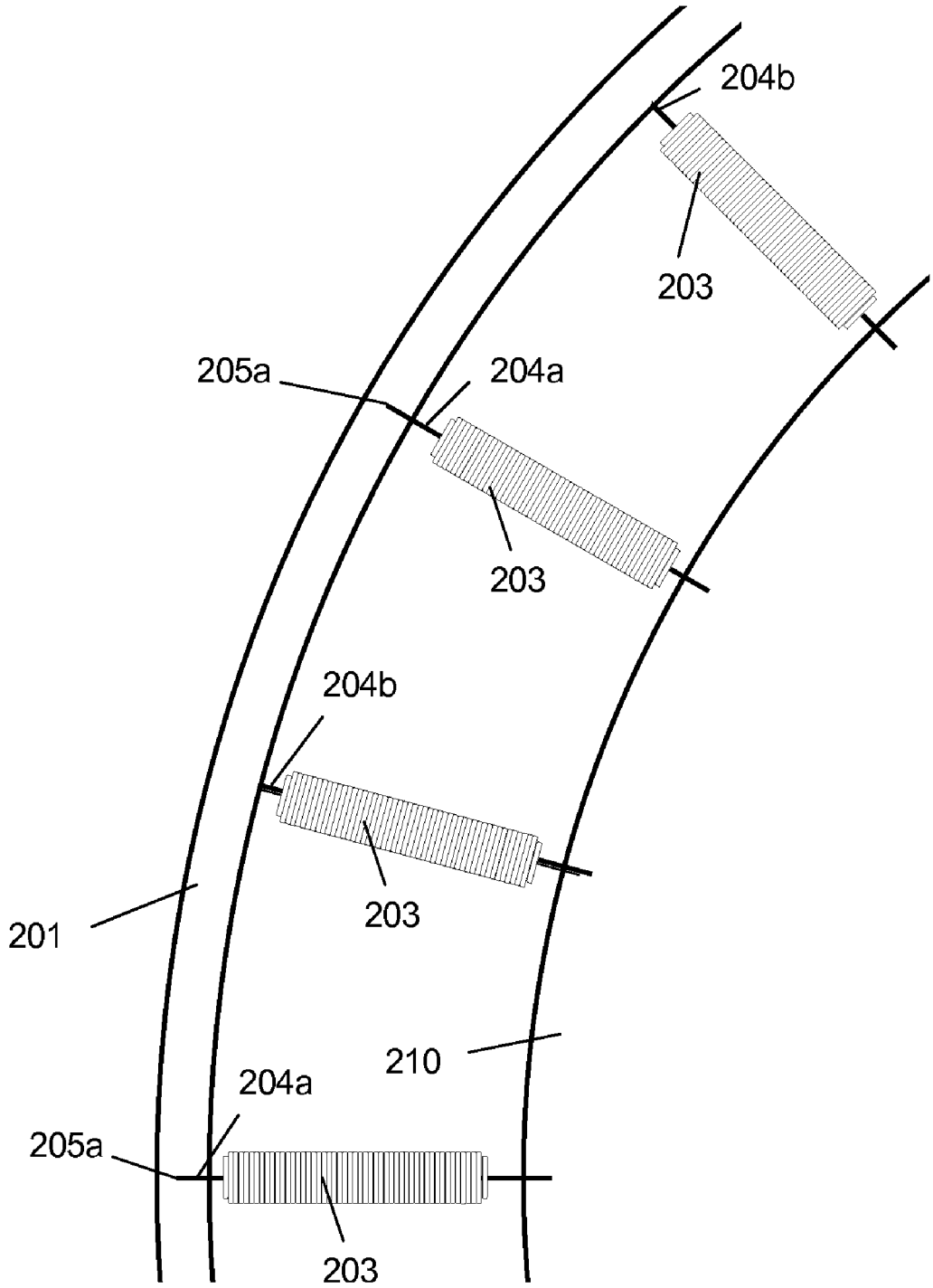
FIG. 3A is an illustrative top view of a portion of a trampoline that has spring members that are configured according to the subject matter disclosed herein.
Figure 3B:
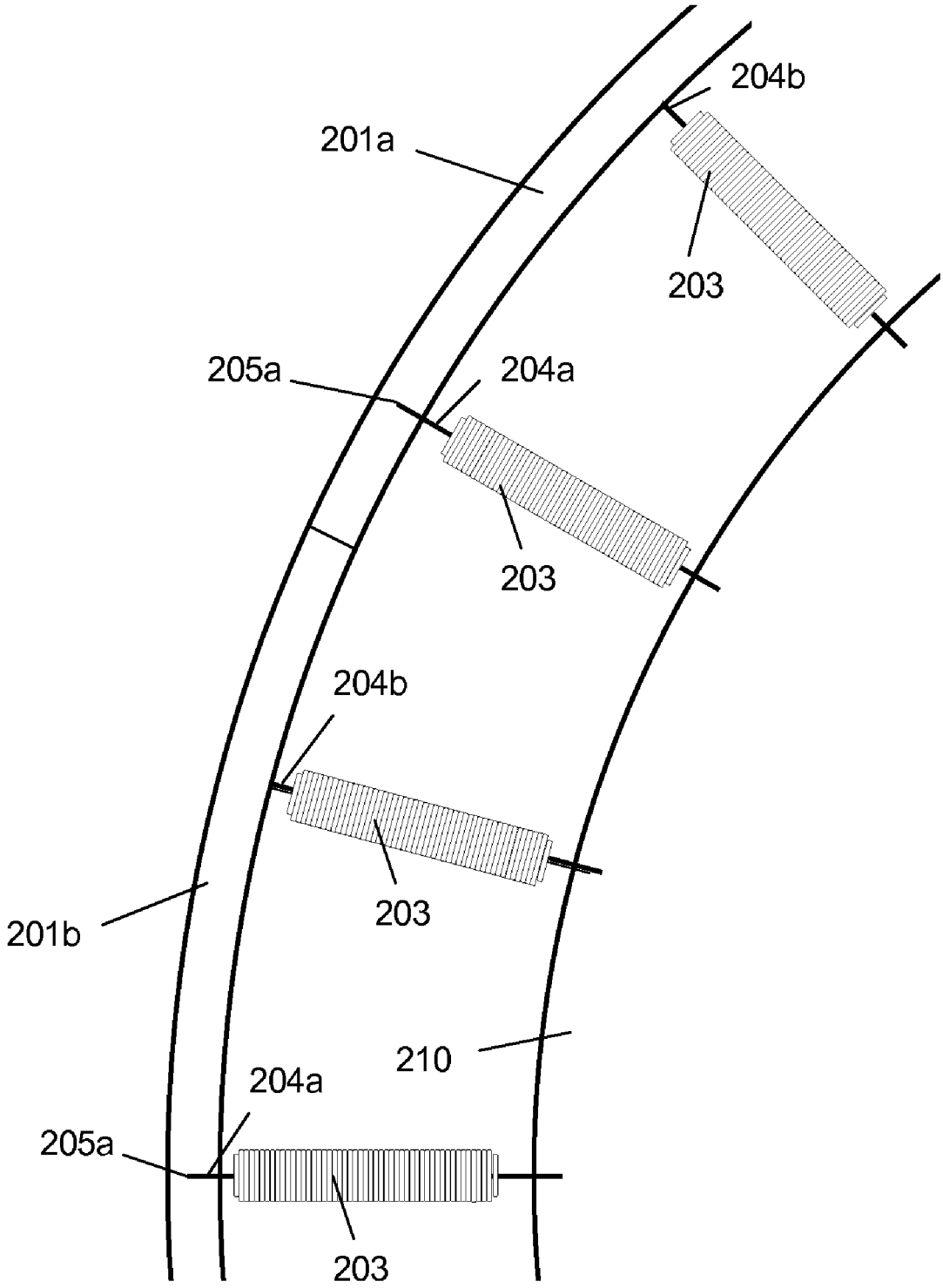
FIG. 3B is an illustrative view of a portion of another embodiment of a trampoline that has spring members that are configured according to the subject matter disclosed herein.
Figure 4:
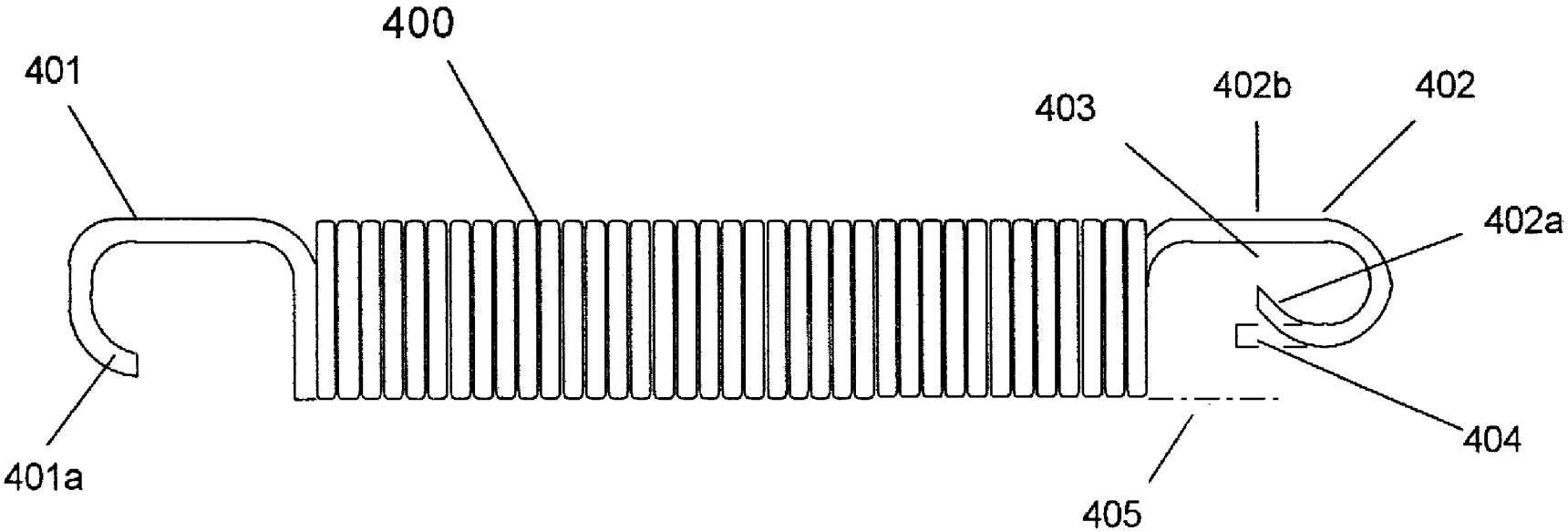
FIG. 4 depicts an illustrative embodiment of a spring member 400 according to the subject matter disclosed herein.

FIG. 4 depicts an illustrative embodiment of a spring member 400 according to the subject matter disclosed herein. Spring member 400 includes a frame-hook member 401 (corresponding to frame hook member 204 in FIG. 2) for inserting through a hole 205 in a trampoline frame and a bed-hook member 402 for inserting through a ring attached to a rebounding surface (rebounding surface 210 in FIG. 3). Frame-hook member 401 includes an end portion 401*a* that is configured to allow insertion of end portion 401 into a frame hole. Bed-hook member 402 includes an end portion 402*a* that is configured so that end portion 402*a* is not exposed and/or easily accessible when spring member 400 is connected to the "bottom" side of a trampoline frame and thereby potentially causing an injury to a user if the user contacts bed hook member 402 and end portion 402*a*. When properly configured, a gap or space 403 is provided between end portion 402*a* and extension portion 402*b* so bed-hook member 402 can be hook, or engaged, through a connecting ring (not shown in FIG. 4) that is coupled to or is part of a rebounding surface. In one illustrative embodiment, bed-hook member 402 and end portion 402*a* are configured so that end portion 402 is oriented toward extension portion 402*b* in a manner that provides a small gap 403 similar to that shown in FIG. 4. In another illustrative embodiment, bed-hook member 402 and end portion 402, as illustratively depicted by dashed lines 404, are configured so that end portion 402*a* is oriented substantially parallel to a projection 405 of the body of spring 400 and so end portion 402*a* is be substantially within a projection 405 of the body of spring 400. It should be understood that bed-hook member 402 and end portion 402*a* can be configured to substantially more closely conform to projection 405 of the body of spring 400 that illustratively depicted in FIG. 4. In still another illustrative embodiment, each spring member 400 that hooks into the "top" or the "bottom" holes of a trampoline frame is configured like illustrative embodiment 400 shown in FIG. 4 and described herein. In yet another illustrative embodiment, only the spring members 400 that hook into the holes on the "bottom" of a trampoline frame is configured like illustrative embodiment 400 shown in FIG. 4 and described herein.

While FIG. 2 shows only a cross-sectional view of a portion of frame 201 and while FIG. 3A depicts a unitary frame 201, it should be understood that frame 201 could be formed from a plurality of frame members (frame members 201*a*, 201*b* shown in FIG. 3B) that when assembled form a single frame structure.

Although the foregoing subject matter has been described in some detail for purposes of clarity of understanding, it will be apparent that certain changes and modifications may be practiced that are within the scope of the appended claims. Accordingly, the embodiments of the subject matter disclosed herein are to be considered as illustrative and not restrictive, and the subject matter disclosed herein is not to be limited to the details given herein, but may be modified within the scope and equivalents of the appended claims.

What is claimed is:

1. A spring arrangement for a trampoline, comprising:

a single rebounding surface comprising a single edge;

a frame structure forming the perimeter of an operative trampoline comprising a top portion and a bottom portion; and a plurality of spring members mechanically coupled between the single edge of the single rebounding surface and the frame structure, a first group of spring members being mechanically coupled directly to the top portion of the frame structure and a second group of spring members being mechanically coupled directly to the bottom portion of the frame structure, each spring member of the second group of spring members comprising a frame hook member that is mechanically coupled directly to the bottom portion of the frame structure and a bed hook member that comprises an end portion that is configured to be within a projection of a body of the spring member and is coupled to the rebounding surface.

2. The spring arrangement according to claim 1, wherein each spring member of the first group of spring members comprising a frame hook member that is mechanically coupled to the top portion of the frame structure and a bed hook member that comprises an end portion that is configured to be within a projection of a body of the spring member and is coupled to the rebounding surface.

3. The spring arrangement according to claim 1, wherein the frame structure comprises a plurality of frame members.

4. The spring arrangement according to claim 1, wherein spring members of the first group and the second group are alternately arranged along the frame structure.

5. The spring arrangement according to claim 4, wherein each spring member of the first group is adjacent to a spring member of the second group.

6. The spring arrangement according to claim 5, wherein each spring member of the first group is adjacent on two sides to a spring member of the second group.

7. The spring arrangement according to claim 4, wherein each spring member of the second group is adjacent to a spring member of the first group.

8. The spring arrangement according to claim 7, wherein each spring member of the second group is adjacent on two sides to a spring member of the first group.

9. The spring arrangement according to claim 4, wherein a first predetermined number of spring member of the first group is alternately arranged along the frame structure with a second predetermined number of spring members from the second group.

10. The spring arrangement according to claim 1, wherein spring members of the first group are arranged along the frame structure to generate a torque that is applied to the frame structure in opposition to a torque generated by spring members of the second group.

11. The spring arrangement according to claim 1, wherein the frame structure comprises at least one frame member, the frame member comprising a top portion and a bottom portion, wherein the plurality of spring members are mechanically coupled between the rebounding surface and the frame member, and wherein the first group of spring members is mechanically coupled to the top portion of the frame member and the second group of spring members is mechanically coupled to the bottom portion of the frame member.

12. The spring arrangement of claim 1, wherein the end portion of each spring member of the second group is substantially parallel to the projection of the respective body.

13. The spring arrangement of claim 1, wherein each spring member of the second group includes an extension portion that couples the end portion to a midportion of the spring member, and wherein the end portion extends toward the extension portion.

14. A spring arrangement for a trampoline, comprising:

a rebounding surface;

a frame structure having at least one frame member forming a portion of the perimeter of an operative trampoline, the frame member comprising a top portion and a bottom portion; and a plurality of spring members mechanically coupled between the rebounding surface and the frame member, a first group of spring members being mechanically coupled directly to the top portion of the frame member and a second group of spring members being mechanically coupled directly to the bottom portion of the frame member, and an end of each of the first group and second group of spring members that is coupled to the rebounding surface being in substantially the same plane, each spring member of the second group of spring members comprising a frame hook member that is mechanically coupled directly to the bottom portion of the frame structure and a bed hook member that comprises an end portion that is configured to be within a projection of a body of the spring member and is coupled to the rebounding surface.

15. The spring arrangement according to claim 14, wherein each spring member of the first group of spring members comprising a frame hook member that is mechanically coupled to the top portion of the frame structure and a bed hook member that comprises an end portion that is configured to be within a projection of a body of the spring member and is coupled to the rebounding surface.

16. The spring arrangement according to claim 14, wherein the frame structure comprises a plurality of frame members.

17. The spring arrangement according to claim 14, wherein spring members of the first group and the second group are alternately arranged along the frame member.

18. The spring arrangement according to claim 17, wherein each spring member of the first group is adjacent to a spring member of the second group.

19. The spring arrangement according to claim 17, wherein each spring member of the first group is adjacent on two sides to a spring member of the second group.

20. The spring arrangement according to claim 17, wherein each spring member of the second group is adjacent to a spring member of the first group.

21. The spring arrangement according to claim 20, wherein each spring member of the second group is adjacent on two sides to a spring member of the first group.

22. The spring arrangement according to claim 14, wherein a first predetermined number of spring member of the first group is alternately arranged along the frame member with a second predetermined number of spring members from the second group.

23. The spring arrangement according to claim 14, wherein spring members of the first group are arranged along the frame member to generate a torque that is applied to the frame structure in opposition to a torque generated by spring members of the second group.

24. The spring arrangement of claim 14, wherein the end portion of each spring member of the second group is substantially parallel to the projection of the respective body.

25. The spring arrangement of claim 14, wherein each spring member of the second group includes an extension portion that couples the end portion to a midportion of the spring member, and wherein the end portion extends toward the extension portion.

* * * * *